US009229349B2

(12) United States Patent
Adachi

(10) Patent No.: US 9,229,349 B2
(45) Date of Patent: Jan. 5, 2016

(54) IMAGE FORMING APPARATUS WHICH CORRECTS FOR COLOR MISREGISTRATION

(71) Applicant: CANON KABUSHIKI KAISHA, Tokyo (JP)

(72) Inventor: Noriaki Adachi, Inzai (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/687,060

(22) Filed: Apr. 15, 2015

(65) Prior Publication Data

US 2015/0301468 A1 Oct. 22, 2015

(30) Foreign Application Priority Data

Apr. 16, 2014 (JP) ..... 2014-084484

(51) Int. Cl.
*G03G 15/01* (2006.01)

(52) U.S. Cl.
CPC ..... *G03G 15/0142* (2013.01)

(58) Field of Classification Search
CPC ..... G03G 15/01; G03G 15/0194; G03G 15/0896; G03G 15/5054; G03G 15/5058; G03G 21/1633; G03G 21/1661; G03G 21/168; G03G 2215/00059; G03G 2215/0132; G03G 2215/0161; G03G 2215/0193
See application file for complete search history.

(56) References Cited

U.S. PATENT DOCUMENTS

2004/0042807 A1* 3/2004 Nakayama ..... 399/49
2009/0003869 A1* 1/2009 Takahashi ..... 399/75
2011/0280633 A1 11/2011 Ino et al.

FOREIGN PATENT DOCUMENTS

JP 2012003234 A 1/2015

* cited by examiner

*Primary Examiner* — Roy Y Yi
(74) *Attorney, Agent, or Firm* — Rossi, Kimms & McDowell LLP

(57) ABSTRACT

An image forming apparatus which is capable of, even when the density of an image in a color with low reflectivity has decreased, detecting a misregistration of this color with high accuracy. A first image of a first color and a second image of a second value having lower reflectivity than that of the first color are transferred to an image carrier. A first signal corresponds to reflected light from a first measurement image, a second signal corresponds to reflected light from a second measurement image, and a third signal corresponds to reflected light from the image carrier. A threshold value is set based on the second signal and the third signal. A color misregistration between the first and second images is corrected based on information on a positional relationship between the first and second images determined by comparing the first signal and the threshold value.

8 Claims, 15 Drawing Sheets

IMAGE FORMING APPARATUS WHICH CORRECTS FOR COLOR MISREGISTRATION

BACKGROUND OF THE INVENTION

1. Field of the Invention

The present invention relates to an image forming apparatus, and in particular to a threshold value setting process in measuring a measurement image.

2. Description of the Related Art

An electrophotographic image forming apparatus has image forming units for respective color components which form images using toners of different colors. Toner images formed by the image forming units for the respective color components are transferred in a superposed manner to an image carrier. The image forming apparatus transfers the toner images superposed on top of one another on the image carrier to a recording material and then fixes the toner images to the recording material through heat and pressure of a fixing device to generate full-color printed matter.

In such an image forming apparatus, if images of the respective colors are out of register when they are transferred in a manner being superposed on top of one another onto an image carrier, color misregistration of the images on a recording material will occur. To address this problem, those which form a measurement image on an image carrier, and based on a result obtained by detecting this measurement image, adjust positions and timings of images to be formed for each image forming unit are known.

For example, when there is not much difference between an intensity of reflected light from an image carrier and an intensity of reflected light from a measurement image formed using a toner of a predetermined color, it is difficult for an optical sensor to detect the measurement image. For this reason, an image forming apparatus forms a composite pattern in which a measurement image of a predetermined color is superposed on a measurement image of another color (other than the predetermined color) and transferred and corrects for a color misregistration based on a detection result of the composite image by an optical sensor (Japanese Laid-Open Patent Publication (Kokai) No. 2012-3234). It should be noted that a reflectivity of the other color is higher than that of the predetermined color.

The image forming apparatus described in Japanese Laid-Open Patent Publication (Kokai) No. 2012-3234 obtains sensor output values output from an optical sensor during movement of an image carrier. The sensor output values of the optical sensor includes a sensor output value corresponding to reflected light from the image carrier and sensor output values corresponding to reflected light from the composite pattern. Further, the sensor output values corresponding to the reflected light from the composite pattern includes a sensor output value corresponding to reflected light from the measurement image of the predetermined color, a sensor output value corresponding to reflected light from the measurement image of the other color, and a sensor output value corresponding to reflected light from an area in which the measurement image of the predetermined color overlaps the measurement image of the other color. The sensor output values of the optical sensor are converted into binary signals based on a threshold value, and a color misregistration is corrected based on the signals.

FIG. 7A is a view showing the relationship between sensor output for a composite pattern and sensor output binary-coded using a threshold value. FIG. 7B is a view showing the composite pattern.

When the density of a measurement image of the predetermined color (for example, a black (K) measurement image) decreases, a sensor output value corresponding to reflected light from the composite pattern may exceed a threshold value as shown in FIG. 7A. This is because when the density of the black image decreases in an area where a magenta (M) image and the black image overlap, the magenta image is seen through the black image. As a result, the sensor can receive reflected light from the magenta image covered with the black image, thereby causing sensor output corresponding to the area where the magenta image and the black image overlap to be higher than the threshold value.

For this reason, when the density of the measurement image of the predetermined color decreases in the composite pattern, the sensor output corresponding to an area of the other color covered with the toner of the predetermined color in the composite image exceeds the threshold value, and hence it is difficult to correct for a color misregistration with high accuracy.

SUMMARY OF THE INVENTION

The present invention provides an image forming apparatus which is capable of, even when the density of an image in a color with low reflectivity has decreased, detecting a misregistration of this color with high accuracy.

Accordingly, the present invention provides an image forming apparatus comprising a first image forming unit configured to form a first image using a toner of a first color, a second image forming unit configured to form a second image using a toner of a second color having lower reflectivity than that of the first color, an image carrier to which the first image and the second image are transferred, a controller configured to control the first image forming unit and the second image forming unit to form a first measurement image and a second measurement image on the image carrier, respectively, wherein the first measurement image including a first pattern formed by the first image forming unit and a second pattern formed by the second image forming unit, wherein the second pattern being superposed on the first pattern in the first measurement image, wherein the second measurement image including a third pattern formed by the first image forming unit and a fourth pattern formed by the second image forming unit, and wherein the fourth pattern being superposed on the third pattern in the second measurement image, an irradiation unit configured to irradiate the first measurement image and the second measurement image with light, a light-receiving unit configured to in a case where the light-receiving unit received reflected light from the first measurement image, output a first signal corresponding to reflected light from the first measurement image, in a case where the light-receiving unit received reflected light from the second measurement image, output a second signal corresponding to reflected light from the second measurement image, and in a case where the light-receiving unit received reflected light from the image carrier, output a third signal corresponding to the reflected light from the image carrier, a setting unit configured to set a threshold value based on the second signal and the third signal output from the light-receiving unit, a determination unit configured to compare the first signal and the threshold value and determine information on a positional relationship between the first image and the second image based on a comparison result, and a correction unit configured correct for a color misregistration between the first image and the second image based on the information.

According to the present invention, the threshold value is determined based on the second signal corresponding to reflected light from the second measurement image and the third signal corresponding to reflected light from the image carrier. Consequently, even when the density of the image of the first color decreases, it is possible to determine information of a positional relationship between the image of the first color and the image of the second color based on the first signal corresponding to reflected light from the first measurement image and the threshold value with high accuracy.

Further features of the present invention will become apparent from the following description of exemplary embodiments (with reference to the attached drawings).

DESCRIPTION OF THE EMBODIMENTS

The present invention will now be described with reference to the drawings showing an embodiment thereof.

Figure 1:
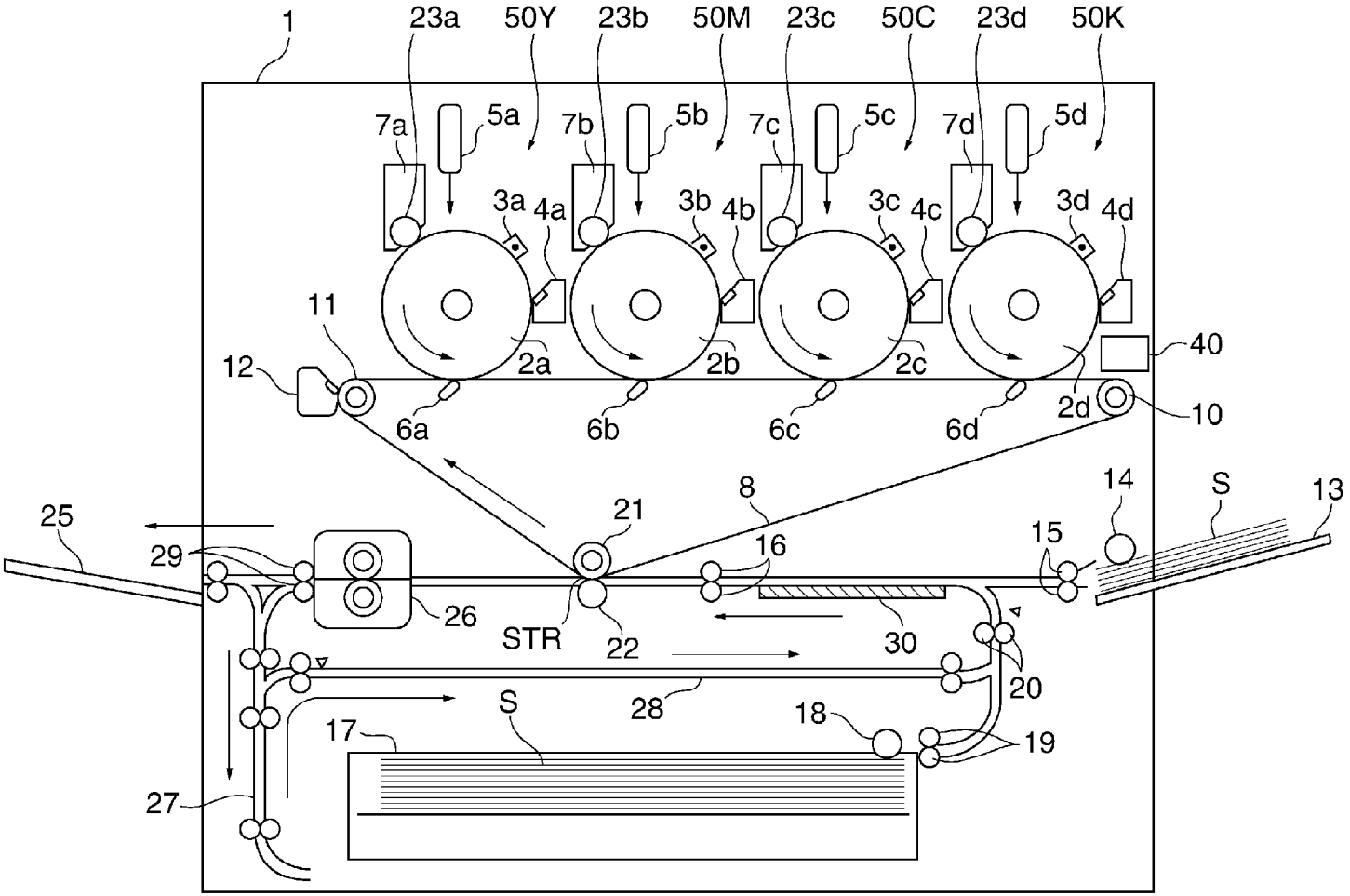
FIG. 1 is a cross-sectional view showing an image forming apparatus according to an embodiment of the present invention.

FIG. 1 is a cross-sectional view schematically showing an image forming apparatus according to an embodiment of the present invention.

This image forming apparatus 1 has four image forming units 50 (50Y, 50M, 50C, 50K) for forming images of four colors, i.e. yellow (Y), magenta (M), cyan (C), and black (K). The image forming units 50 have common component elements, and hence in the following description, when no distinctions are made among the image forming units 50 in terms of their component elements, the same reference numerals are used, and when distinctions are made among them, characters a, b, c, and d corresponding to Y, M, C, and K, are suffixed to reference symbols.

The image forming units 50 have respective photosensitive members 2 (2*a*, 2*b*, 2*c*, 2*d*) which are photosensitive drums. Chargers 3 (3*a*, 3*b*, 3*c*, 3*d*) for electrically charging the photosensitive members 2 are provided around the respective photosensitive members 2. Laser scanning units 5 (5*a*, 5*b*, 5*c*, 5*d*) which output light beams (laser light) for forming electrostatic latent images on surfaces of the electrically-charged photosensitive members 2 are also provided around the respective photosensitive members 2. Further, developing devices 7 (7*a*, 7*b*, 7*c*, 7*d*) and cleaners 4 (4*a*, 4*b*, 4*c*, 4*d*) are provided around the respective photosensitive members 2.

The developing devices 7 have developing sleeves 23 (23*a*, 23*b*, 23*c*, 23*d*). The developing sleeves 23 of the respective developing devices 7 bear developers containing toners 122 and carriers 121.

When laser is radiated from the laser scanning units 5 of which light sources are semiconductor lasers, electrostatic latent images are formed on surfaces of the photosensitive members 2. The electrostatic latent images on the photosensitive members 2 are developed into toner images by the developing devices 7, and the toner images of the respective colors are superposed as on top of one another on an intermediate transfer belt 8, which is an image carrier, by primary transfer units 6 (6*a*, 6*b*, 6*c*, 6*d*).

The intermediate transfer belt 8 is rotatively driven by a drive unit, not shown, via supporting rollers 10, 11, and 21. The toner images of the respective colors superposed on top of one another on the intermediate transfer belt 8 are conveyed to a secondary transfer unit 22 and collectively transferred onto a sheet S being conveyed to the secondary transfer unit 22. The cleaners 4 remove toner remaining on the surfaces of the photosensitive members 2. A cleaner 12 removes toner remaining on the intermediate transfer belt 8.

The sheet S onto which the toner images of the four colors have been collectively transferred by the secondary transfer unit 22 is conveyed to a fixing device 26, which in turn thermally fixes the unfixed toner images, and then discharged to a discharged sheet tray 25 via sheet discharging rollers 29.

On the other hand, the sheet S is fed from a sheet feeding cassette 17, a manual feed tray 13, or the like to a conveying path, corrected for its lateral position by an electrostatic conveying device 30, and conveyed to the secondary transfer unit 22 while being timed by registration rollers 16.

On this occasion, sheet conveying units for feeding the sheet S from the sheet feeding cassette 17 to the convening path, such as pickup rollers 18 and 19, vertical path rollers 20, and the registration rollers 16, are driven by respective stepping motors independent of one another so as to realize fast and stable conveyance. Sheet conveying units for feeding the sheet S from the manual feed tray 13 to the conveying path, such as pickup rollers 14 and 15, are also driven by respective stepping motors independent of one another.

During double-sided printing, the sheet S having passed through the fixing device 26 is guided from the sheet discharging rollers 29 to a double-sided inverting path 27 and then conveyed in an inverted state to a double-sided path 28. The sheet S having passed through the double-sided path 28 passes through the vertical path rollers 20 again and is conveyed to the secondary transfer unit 22 in the same way. The toner images of the respective colors are collectively transferred from the intermediate transfer belt 8 onto a back side of the sheet S conveyed to the secondary transfer unit 22, and after the transfer, the sheet S is discharged onto the discharged sheet tray 25 via the fixing device 26 and the sheet discharging rollers 29.

In the image forming apparatus 1, a color misregistration sensor 40 is disposed downstream of the photosensitive member 2*d* on the intermediate transfer belt 8 and in proximity to a surface of the intermediate transfer belt 8. The color misregistration sensor 40 is for detecting color misregistration detection patterns which are color misregistration toner patterns transferred from the photosensitive members 2*a* to 2*d* onto the intermediate transfer belt 8, and for example, one having an optical arrangement is adopted. The color misregistration sensor 40 is controlled so that the drive timing of the color misregistration sensor 40 and the timing at which the color misregistration detection patterns pass through a measurement position are synchronized with each other.

Figure 8:
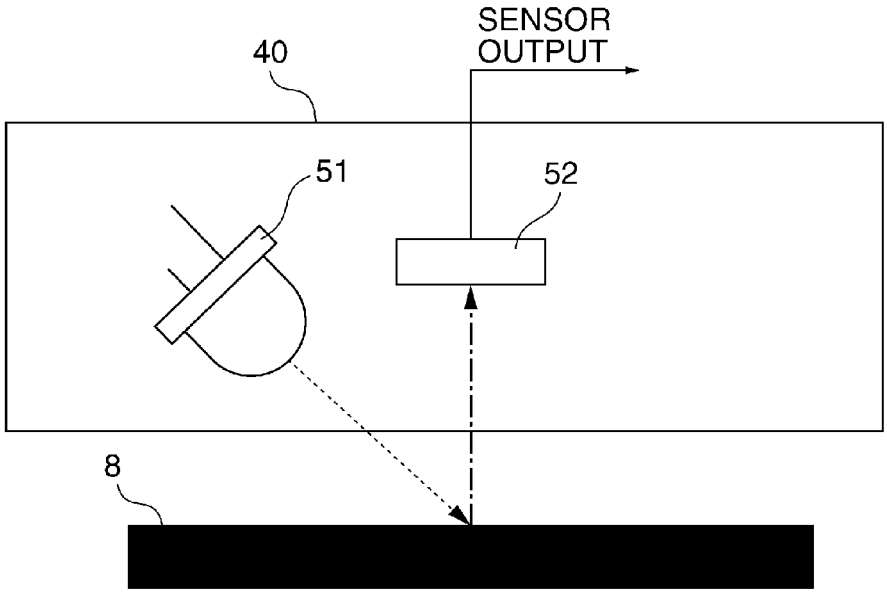
FIG. 8 is a diagram showing an arrangement of a color misregistration sensor and a detection method therefor.

FIG. 8 is a diagram showing an arrangement of the color misregistration sensor 40 and a detection method therefor.

The color misregistration sensor 40 has a light emitting unit 51 and a light receiving unit 52 and is configured such that reflected light from an object which has received light from the light emitting unit 51 is detected by the light receiving unit 52. Light emitted from the light-emitting unit 51 is shot on the intermediate transfer belt 8, which lies in opposed relation to the light emitting unit 51, or color misregistration detection patterns on the intermediate transfer belt 8, and then reflected light falls on the light receiving unit 52. The output voltage of the light receiving unit 52 varies according to the amount of light incident on the light receiving unit 52. Thus, the color misregistration sensor 40 outputs a signal according to the amount of light received by the light receiving unit 52.

Figure 9:
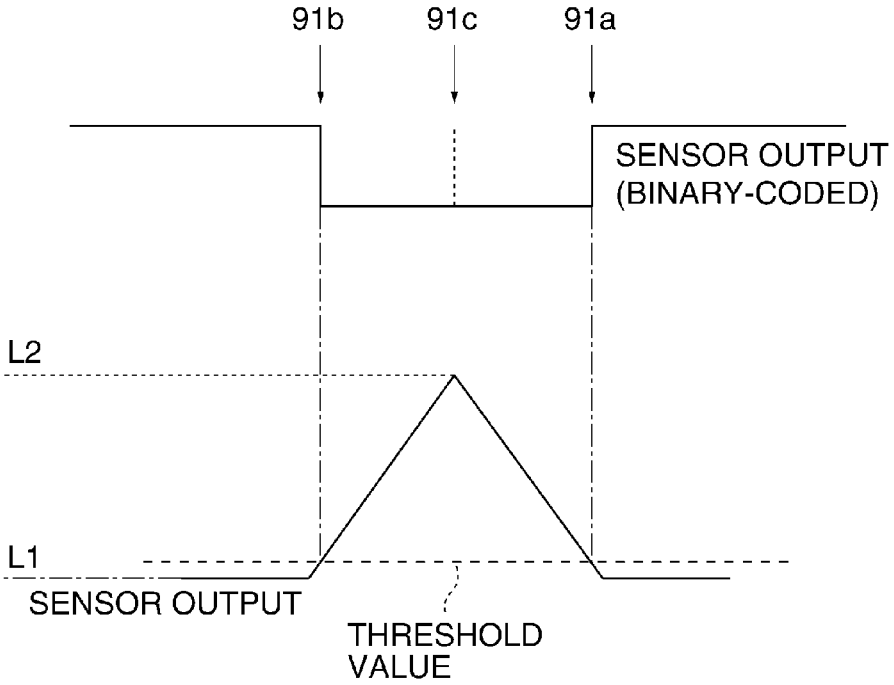
FIG. 9 shows an output waveform in a case where the color misregistration sensor reads a color misregistration detection pattern.

FIG. 9 shows an output waveform in a case where the color misregistration sensor 40 reads a color misregistration detection pattern on the intermediate transfer belt 8. An output signal from the color misregistration sensor 40 when it has received reflected light from the intermediate transfer belt 8 is at a level L1. A color misregistration detection pattern of chromatic color has higher reflectivity than that of the intermediate transfer belt 8, and hence the peak of an output signal from the color misregistration sensor 40 when it has received reflected light from the color misregistration detection pattern is at a level L2 higher than the level L1. A threshold value is set at a level between the level L2 and the level L1. In a case where the output signal from the color misregistration sensor 40 exceeds the threshold value, the output signal is conversed into a binary-coded signal at a Low level. On the other hand, in a case where the output signal from the color misregistration sensor 40 is less than the threshold value, the output signal is conversed into a binary-coded signal at a High level.

Based on a rising edge 91*a* and a falling edge 91*b* of a sensor output (binary-coded) which is a binary-coded digital signal, a pattern reading unit 712 (FIG. 10) of a CPU 70, to be described later, calculates a median value 91*c* of the sensor output (binary-coded). This median value 91*c* is the detection timing of the color misregistration detection pattern in a convening direction. It should be noted that although in the present embodiment, the median value 91*c* is defined as the detection timing, the rising edge 91*a*, for example, may be defined as the detection timing, or the falling edge 91*b* may be defined as the detection timing.

Figure 10:
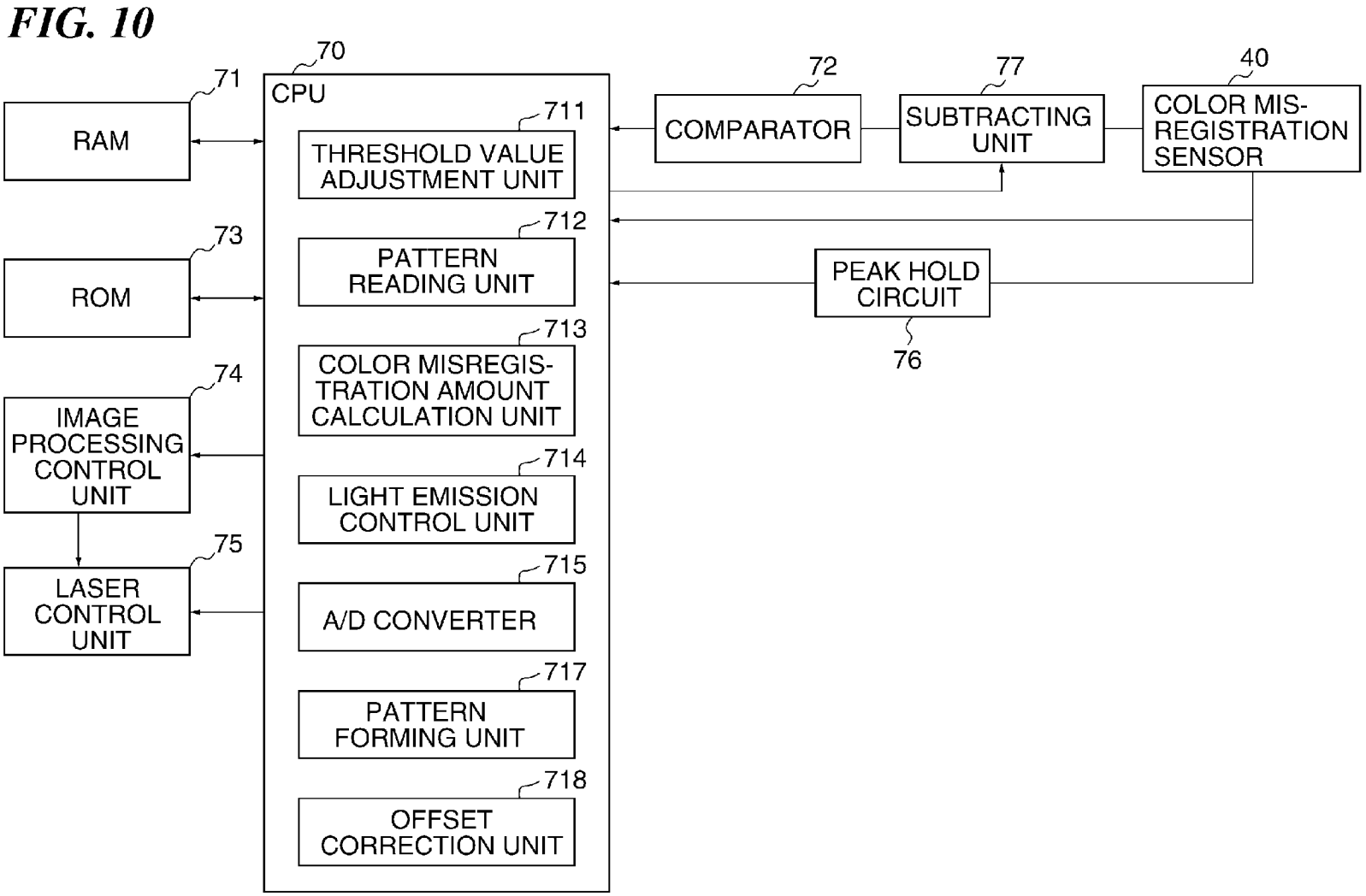
FIG. 10 is a block diagram showing a control mechanism of the image forming apparatus.

FIG. 10 is a block diagram showing a control mechanism of the image forming apparatus 1.

The CPU 70 is a nerve center of a control system in the image forming apparatus 1 and controls a variety of instructions. The CPU 70 has a threshold value adjustment unit 711, the pattern reading unit 712, a color misregistration amount calculation unit 713, a light emission control unit 714, an A/D converter 715, a pattern forming unit 717, and an offset correction unit 718.

A RAM 71, an image processing control unit 74, and a laser control unit 75 are connected to the CPU 70. Control by the CPU 70 is exercised based on a control program stored in the ROM 73. The color misregistration sensor 40 is connected to the CPU 70 and also connected to the CPU 70 via a subtracting circuit 77 and a comparator 72. The subtracting circuit 77 and a peak hold circuit 76 are connected to the CPU 70.

The color misregistration sensor 40 outputs a detection signal obtained by reading a color misregistration detection pattern, and the detection signal is input to the comparator 72 via the subtracting circuit 77. The detection signal, which is a sensor output input to the comparator 72, is binary-coded using a threshold value th set by the CPU 70. The binary-coded detection signal is input to the CPU 70. The peak hold circuit 76 is for use in holding an output level of the color misregistration sensor 40 and capturing it into the CPU 70 in an offset correction setting process, to be described later.

The threshold value adjustment unit 711 of the CPU 70 sets the threshold value th for use by the comparator 72. The pattern reading unit 712 calculates the median value 91*c* of the color misregistration detection pattern to calculate the detection timing for the color misregistration detection pattern. The color misregistration amount calculation unit 713 calculates the amount of color misregistration based on the detection timing calculated by the pattern reading unit 712.

The light emission control unit 714 controls light emission of the light emitting unit 51 of the color misregistration sensor 40. The A/D converter 715 is for use in sampling an output level of the color misregistration sensor 40. At the time of forming a color misregistration detection pattern, the pattern forming unit 717 sends pattern data to the laser control unit 75. The offset correction unit 718 sets an offset correction value for use in setting a GND level based on an output level of the color misregistration sensor 40 when the color misregistration sensor 40 detects the intermediate transfer belt 8. The CPU 70 sets the offset correction value in the subtracting circuit 77 to perform offset correction.

Figure 2A:
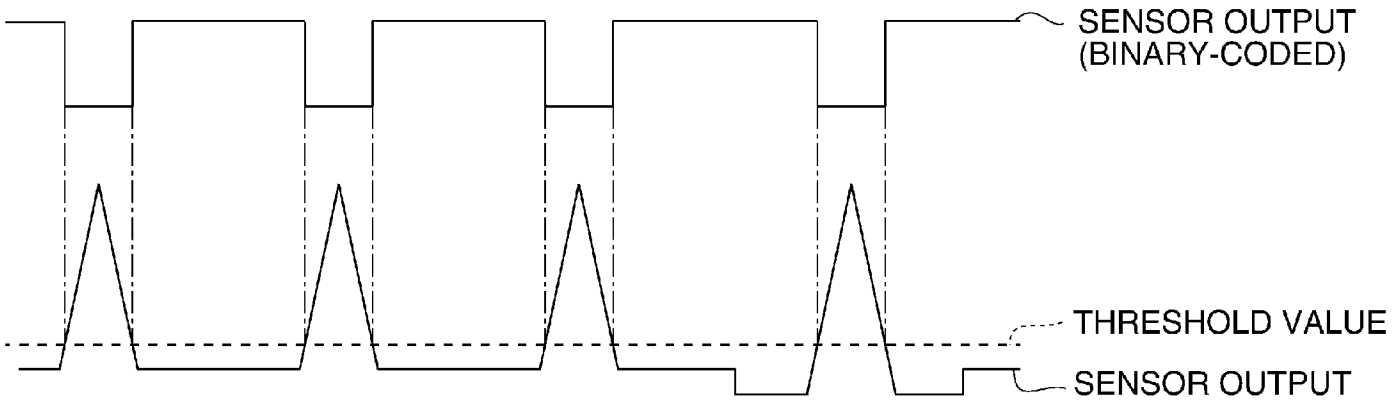
FIG. 2A is a diagram showing detection output for a color misregistration detection pattern group.
Figure 2B:
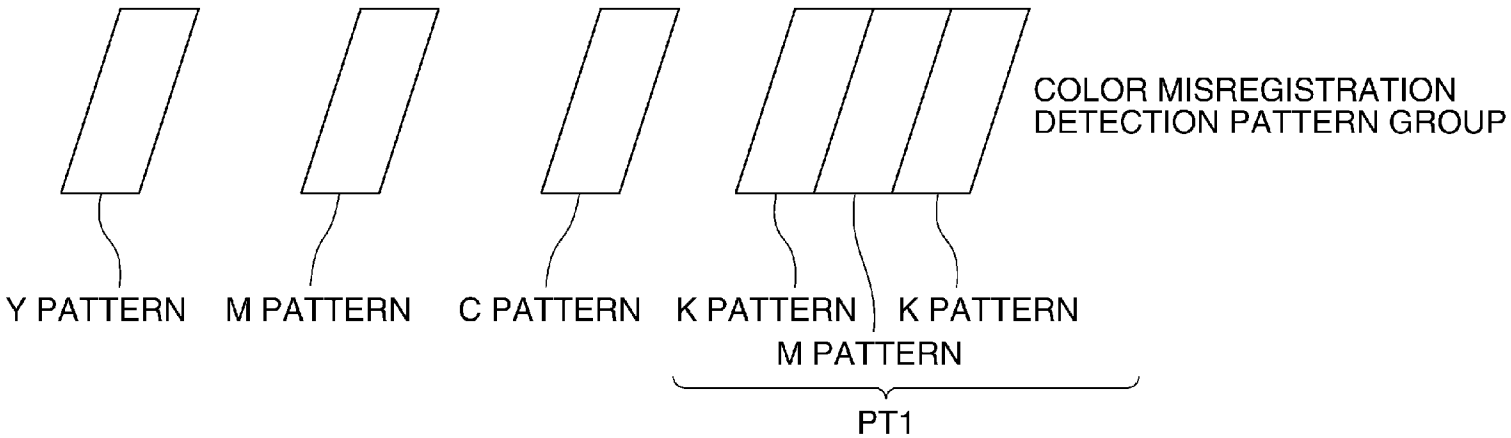
FIG. 2B is a view showing a color misregistration detection pattern group.

A detailed description will now be given of how color misregistration is detected. FIG. 2A is a diagram showing detection output for measurement images. FIG. 2B is a view showing measurement images (color misregistration detection patterns).

The color misregistration detection patterns include monochromatic patterns of Y, M, and C and a composite pattern PT1 comprised of M and K, and they are formed on the image carrier (the intermediate transfer belt 8) (FIG. 2B). When reflected light from these measurement images are detected by the optical sensor (the color misregistration sensor 40), a sensor output (detection waveform) is obtained.

FIG. 2A shows the relationship between sensor output and a digital signal obtained by binary-coding the sensor output using a threshold value. A measurement image of chromatic toner has higher reflectivity than that of an image carrier, and hence sensor output is higher when a chromatic measurement image is detected. However, a measurement image of black toner has lower reflectivity than that of an image carrier, and hence sensor output is lower when a black image is detected.

The sensor output is binary-coded using the threshold value to obtain a pulse waveform, and the amount of color misregistration is calculated based on, for example, the input timing of this pulse waveform. A description will now be given of the composite pattern PT1 with reference to FIG. 3.

Figure 3:
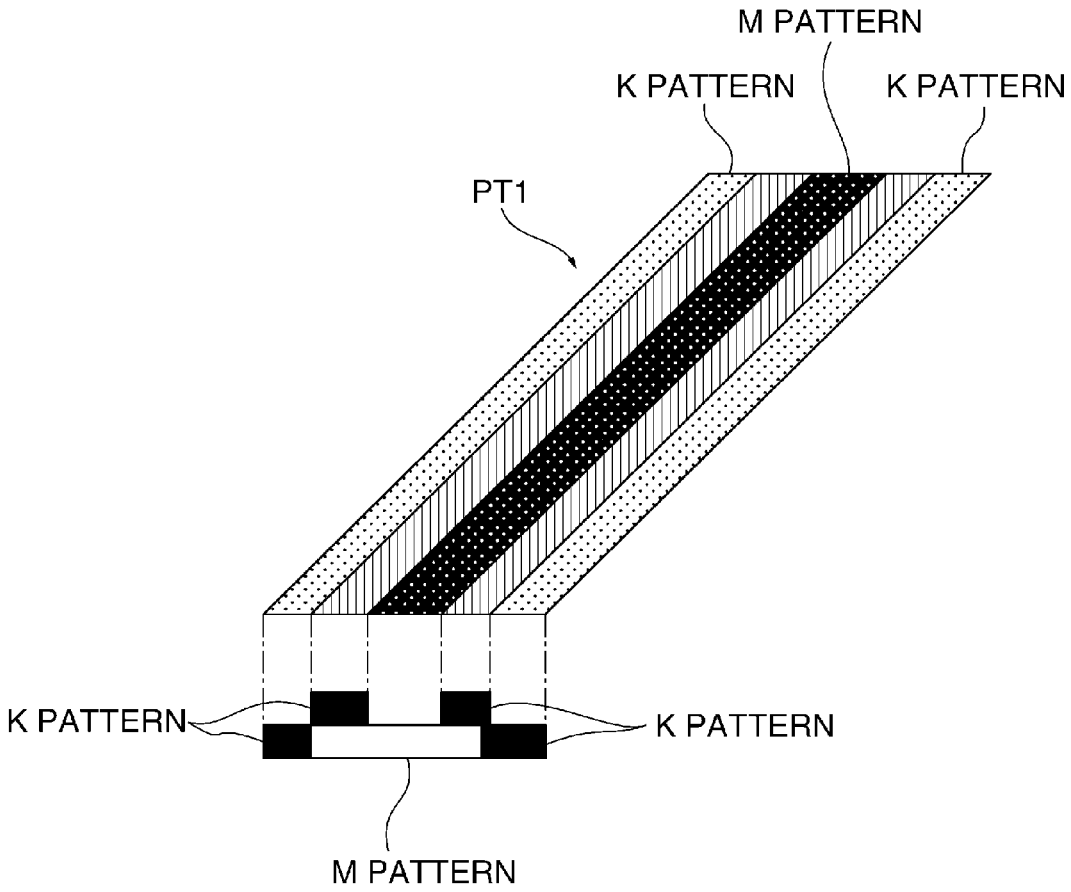
FIG. 3 is a view showing a composite pattern.

FIG. 3 is a view showing the composite pattern PT1 as seen from a direction vertical to the surface of the intermediate transfer belt, as well as a schematic view taken from a lateral side.

The composite pattern PT1 is formed by overlaying achromatic black patterns with predetermined intervals left therebetween on a part of a chromatic magenta pattern. When a color misregistration of black relative to magenta occurs, the timing of sensor output shifts, and hence the color registration is detected.

Figure 4A:
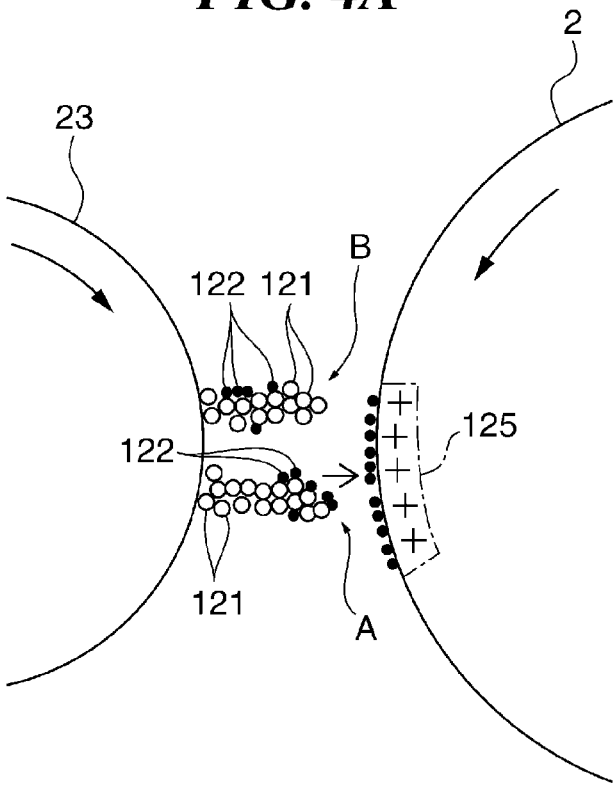
FIGS. 4A and 4B are schematic diagrams showing how a developer behaves in a gap between a developing sleeve and a photosensitive member.
Figure 4B:
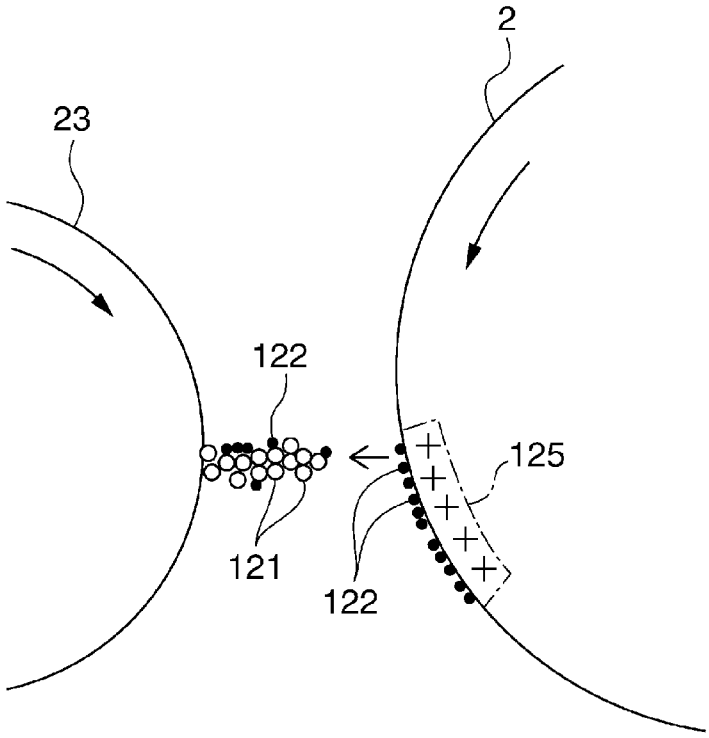

Generally, in an image forming apparatus of a two-component development type which forms a toner image using a developer containing toners and carriers which electrically charge the toners, there is a difference in circumferential speed between a developing sleeve which bears the developer and a photosensitive member. This aims at improving the developability of toner when an electrostatic latent image formed on the photosensitive member is developed. During development, a phenomenon in which as for the density of a toner image developed on the photosensitive member at a trailing end thereof in a rotational direction, the density of a part of the toner image on an upstream side in the rotational direction is lower than that of a central part of the toner image. Referring to FIGS. 4A and 4B, a detailed description will now be given of the reason why the density of a trailing end of a toner image decreases like this.

FIGS. 4A and 4B are schematic diagrams showing how a developer behaves in a gap between the developing sleeve and the photosensitive member.

A developer for use in forming a toner image contains toners 122 (black grains) and carriers 121 (outlined grains) which electrically charge the toners 122. Referring to FIG. 4A, magnetic brushes comprised of the carriers 122 in a brush form are formed on the developing sleeve 23. The toners 122 of the polarity opposite to that of the carriers 121 are attached to the magnetic brushes. When the rotational speed of the photosensitive member 2 and the rotational speed of the developing sleeve 23 are equal, the amount of toners attached to the magnetic brushes may be smaller than the amount of toners required to develop an electrostatic latent image.

On the other hand, when the rotational speed of the developing sleeve 23 is higher than that of the photosensitive member 2, the amount of toners supplied to a gap between the photosensitive member 2 and the developing sleeve 23 increases. Thus, making the rotational speed of the developing sleeve 23 higher than that of the photosensitive member 2 prevents toners from running short, and hence even when a high-density image is to be formed, image density does not decrease.

For example, the carriers 121 are positively charged, and the toners 122 are negatively charged. It is assumed that an electrostatic latent image on the photosensitive member 2 is an area 125 positively charged by exposure to an optical beam.

As a magnetic brush comes close to the photosensitive member 2, the toners 122 attached to the magnetic brush are attracted to the electrostatic latent image on the photosensitive member 2, and the electrostatic latent image is developed by the toners 122 (toners of a magnetic brush indicated by A) (FIG. 4A).

On the other hand, at a trailing end of the electrostatic latent image (the area 125) on the surface of the photosensitive member 2 in a moving direction thereof, there is a boundary portion between an exposed potential area which is positively charged and a charged potential area which is negatively charged. Since the charged potential area is negatively charged, the toners 122 attached to a magnetic brush (toners of a magnetic brush indicated by B) are caused to move in such a direction as to go away from the photosensitive drum 2 by the magnetic brush coming close to the charged potential area which follows the exposed potential area. As a result, the carriers 121 at ends of magnetic brushes near the trailing end of the area 125 become exposed.

Since the rotational speed of the developing sleeve 23 is higher than that of the photosensitive member 2, the magnetic brushes at the ends of which the carriers 121 are exposed successively come close to the trailing end of the electrostatic latent image (the area 125). For this reason, as shown in FIG. 4B, the toners 122 at the trailing end of the area 125 on the photosensitive member 2 are pulled back to the carriers 121 exposed at the ends of the magnetic brushes. As a result, the density of the trailing end of a developed toner image is lower than a predetermined density.

Figure 5:
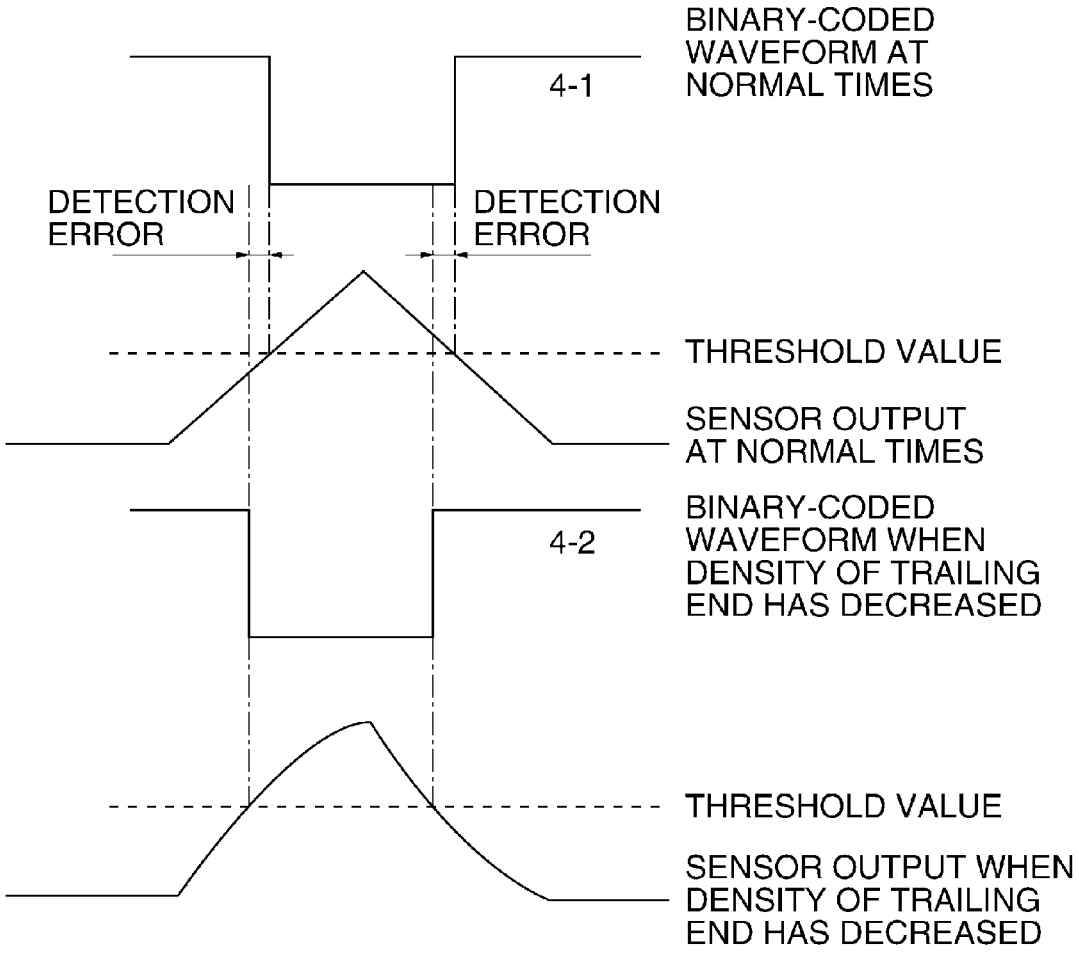
FIG. 5 is a view showing the relationship between sensor output and sensor output binary-coded using a large threshold value before and after the density of a trailing end of a toner image decreases.
Figure 6:
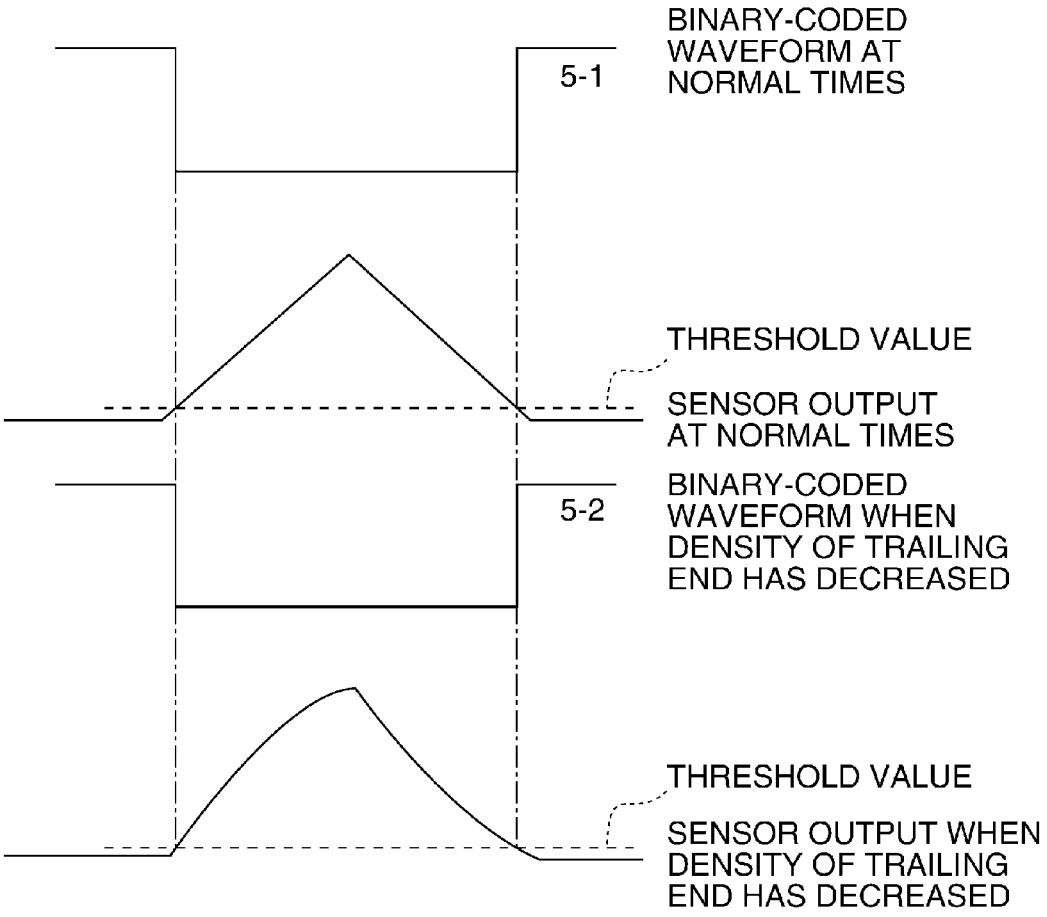
FIG. 6 is a view showing the relationship between sensor output and sensor output binary-coded using a small threshold value before and after the density of a trailing end of a toner image decreases.

Referring to FIGS. 5 and 6, the relationship between sensor output and sensor output binary-coded using a threshold value before and after a decrease in the density of a trailing end of a toner image as described above will be described by comparing different threshold values together.

Referring to FIG. 5, a signal obtained by binary-coding sensor output for a color misregistration detection pattern with a normal density using a threshold value, of which the density at a trailing end in the rotational direction of the photosensitive drum 2 has not decreased, is assumed as a binary-coded signal 4-1. A signal obtained by binary-coding sensor output for a color misregistration detection pattern using a threshold value, of which the density at a trailing end has decreased is assumed as a binary-coded signal 4-2. When a threshold value for use in binary coding is set to be as large as half a peak level of sensor output, there is an error in detection timing between the binary-coded signal 4-1 obtained when the density is normal and the binary-coded signal 4-2 obtained when the density at the trailing end has decreased.

On the other hand, as for a waveform same as that in FIG. 5, a case where a threshold value for use in binary coding is set to be as small as about one-tenths of a peak level of sensor output is as shown in FIG. 6.

Even when the density of the trailing end of the color misregistration detection pattern decreases, the timing at which a sensor output starts rising does not change. For this reason, by setting a threshold value for use in binary coding at a small threshold value, there is almost no error in detection timing between a binary-coded signal 5-1 obtained when the density is normal and a binary-coded signal 5-2 obtained when the density at the trailing end has decreased.

For the reasons stated above, a threshold value for use in binary coding a sensor output obtained by detecting a color misregistration detection pattern is typically set at a small value.

Figure 7A:
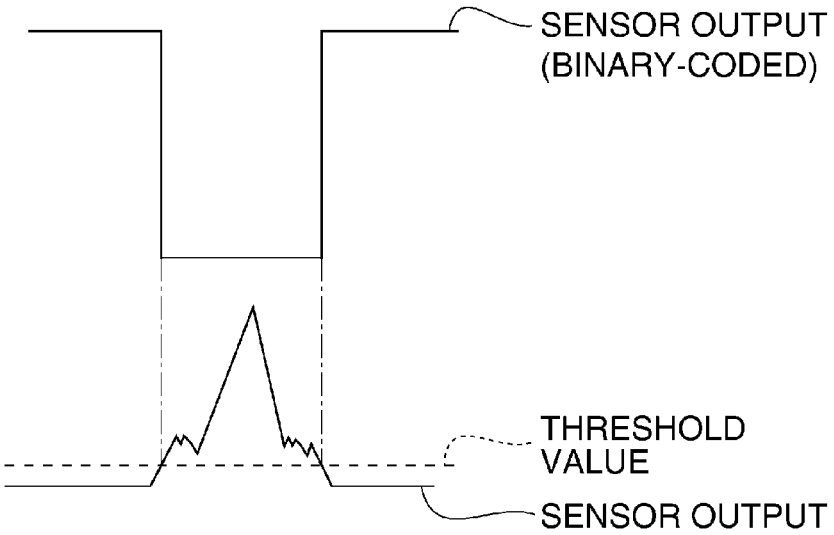
FIG. 7A PRIOR ART
FIG. 7A is a view showing the relationship between sensor output and binary-coded sensor output for a composite pattern according to a prior art.
Figure 7B:
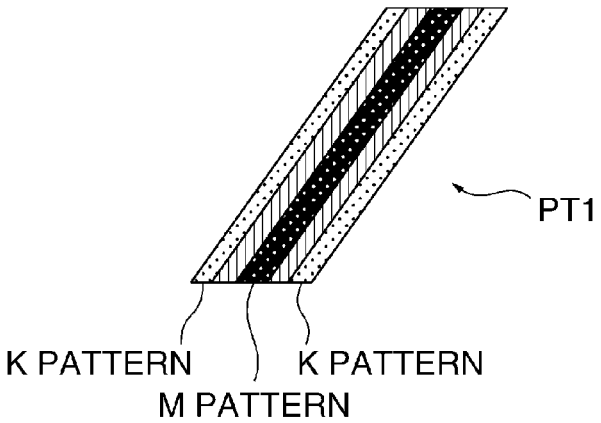
FIG. 7B PRIOR ART
FIG. 7B is a view showing the composite pattern according to the prior art.

However, as described above with reference to FIGS. 7A and 7B, when sensor output obtained by detecting the composite pattern PT1 is binary-coded using a threshold value set small, a highly accurate detection result by a sensor is not secured.

Accordingly, a level detection composite pattern PT2 different from the composite pattern PT1 is formed so as to set an offset correction value, and the offset correction value is determined based on a detection result of the level detection composite pattern PT2.

The main reason why the CPU 70 performs offset correction as described above is an increase in the amount of diffusely reflected light received by the color misregistration sensor 40 because of the detection level of the intermediate transfer belt 8 being inconstant and the gloss of the intermediate transfer belt 8 being decreased. The increase in diffusely reflected light increases the sensor output value of the intermediate transfer belt 8. As described earlier, in the case where the threshold value th is set small so as to cope with a decrease in the density of a trailing end of a color misregistration detection pattern, when the sensor output value corresponding to reflected light from the intermediate transfer belt 8 is higher than the threshold value th, binary coding of the sensor output is impossible. In order to prevent this, offset correction is performed.

In the present embodiment, color misregistration detection patterns are transferred onto the intermediate transfer belt 8 by the image forming units 50. The color misregistration detection patterns of the respective colors and how the amount of color misregistration is calculated will now be described with reference to FIGS. 11A and 11B.

Figure 11A:
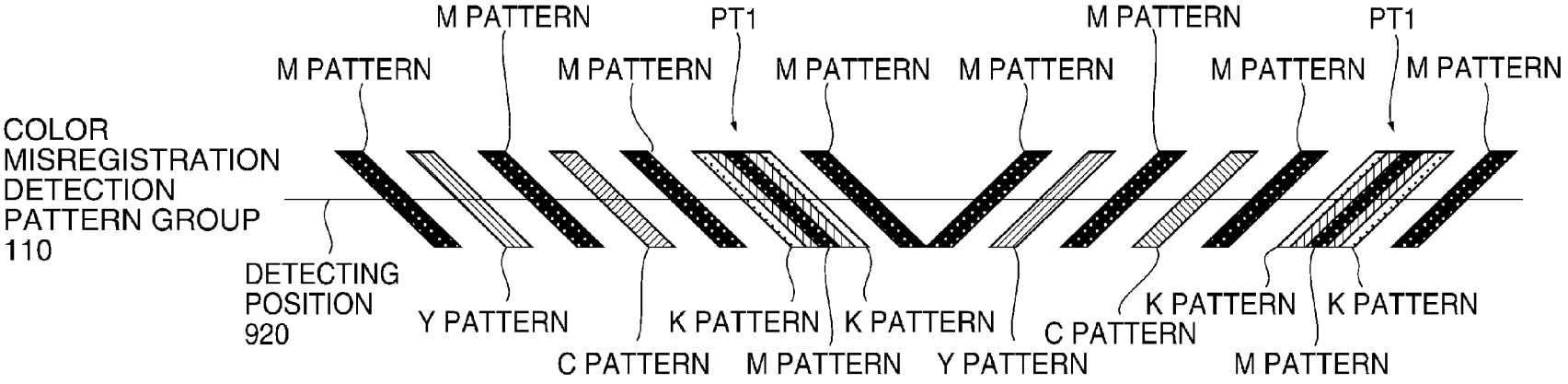
FIG. 11A is a view showing a color misregistration detection pattern group.
Figure 11B:
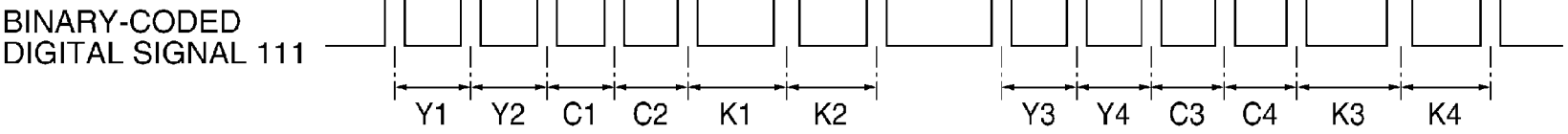
FIG. 11B is a view showing a digital signal obtained by binary-coding sensor output for the color misregistration detection pattern group in FIG. 11A.

FIG. 11A is a view showing a color misregistration detection pattern group formed on an image carrier. FIG. 11B is a view showing a digital signal obtained by binary-coding sensor output for the color misregistration detection pattern group.

A width direction and a moving direction (conveying direction) of the intermediate transfer belt 8 correspond to a main scanning direction and a sub scanning direction, respectively, of the photosensitive drums 2. The color misregistration detection pattern group 110, which is comprised of color misregistration detection images, includes magenta (M) patterns, which are patterns of a reference color, yellow (Y) patterns, cyan (C) patterns, and composite patterns PT1 (first measurement images). The M, Y, and C patterns are single color pattern images. The composite patterns PT1, which are pattern images for detecting a position at which an achromatic black toner image is formed, are formed by the image forming units 50M (first image forming unit) and 50K (second image forming unit) under the control of the CPU 70. To calculate the amounts of color misregistration in a conveying direction of the intermediate transfer belt 8 and the amount of color misregistration in a direction perpendicular to the conveying direction, each pattern is tilted at 45 degrees with respect to the moving direction of the intermediate transfer belt 8. The Y, C, and PT1 patterns are placed so that each of them is sandwiched between the M patterns which are patterns of the reference color.

The composite patterns PT1 have an arrangement described earlier with reference to FIG. 3, and each of them is formed by placing black toner images with predetermined intervals left therebetween on a magenta toner image such that at least a part of the black toner images is overlaid on the magenta toner image. In the example shown in FIG. 3, the K patterns are laid over the M pattern to overlap a front end and a rear end of the M pattern in the moving direction of the intermediate transfer belt 8, and the M pattern exposes itself from a gap between the front K pattern on a front side and the K pattern on a rear side.

Referring to FIG. 11B, sensor output obtained by detecting respective patterns of the color misregistration detection pattern group 110 are binary-coded using a threshold value by the comparator 72 to obtain a digital signal 111. The CPU 70 measures time intervals Y1, Y2, C1, C2, K1, K2, Y3, Y4 . . . between signals of the perspective colors in the digital signal 111 and successively stores these data in the RAM 71. Based on the stored data, the CPU 70 measures positions of the respective colors relative to magenta (M) in the moving direction and the width direction of the intermediate transfer belt 8.

The amount of color misregistration ΔHy of yellow (Y) with respect to magenta (M) in the moving direction of the intermediate transfer belt 8 is calculated using the following equation, $$\Delta Hy=\{(Y4-Y3)/2-(Y2-Y1)/2\}/2.$$

The amount of color misregistration ΔVy of yellow (Y) with respect to magenta (M) in the width direction of the intermediate transfer belt 8 is calculated using the following equation, $$\Delta Vy=\{(Y4-Y3)/2+(Y2-Y1)/2\}/2.$$

The amounts of color misregistration of C and K (ΔHc, ΔHk, ΔVc, ΔVk) relative to magenta (M) are also calculated in the same manner.

The CPU 70 performs color registration by controlling the image processing control unit 74 to control the image write timings of Y, C, and K based on the amounts of color misregistration ΔH and ΔV. Namely, the CU 70 controls the output timing of laser light from the laser scanning unit 5 so as to eliminate ΔH and ΔV.

Referring next to FIGS. 12 to 16, a description will be given of sequences related to setting of an offset correction value, setting of a threshold value, and calculation of the amount of color misregistration, which are performed by the CPU 70. The sequence for setting an offset correction value is a characteristic of the present invention. A level detection composite pattern different from the composite pattern T1 is used to set an offset correction value.

Figure 12:
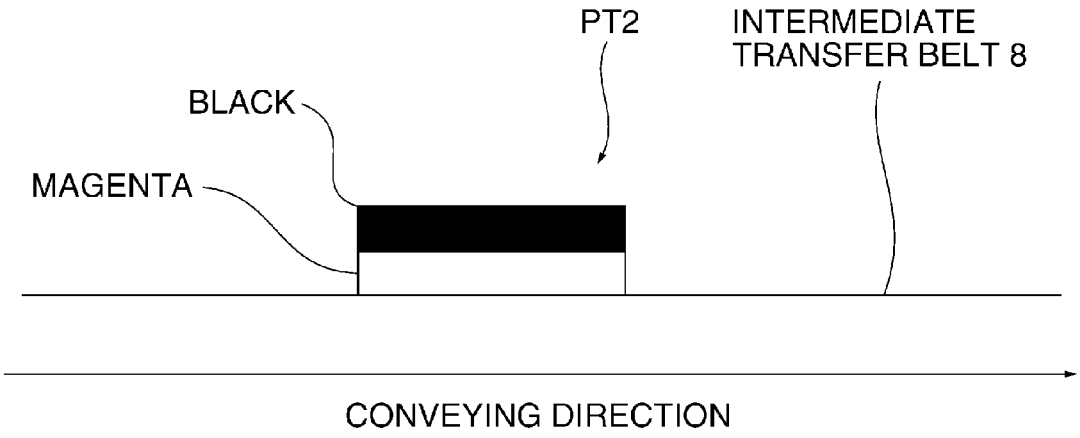
FIG. 12 is a side view showing an exemplary level detection composite pattern.

FIG. 12 is a side view showing an exemplary level detection composite pattern.

This level detection composite pattern PT2 (second measurement image) is formed by the image forming units 50M and 50K under the control of the CPU 70. The level detection composite pattern PT2 (hereafter abbreviated sometimes as "the composite pattern PT2") is formed by overlaying a pattern of black (K) which is a second color on a pattern of magenta (M) which is a first color formed on the intermediate transfer belt 8. The CPU 70 compares a detection level of the intermediate transfer belt 8 and a detection level of the composite pattern PT2 with each other, and based on the result, sets an offset correction value for the subtracting circuit 77.

Figure 13:
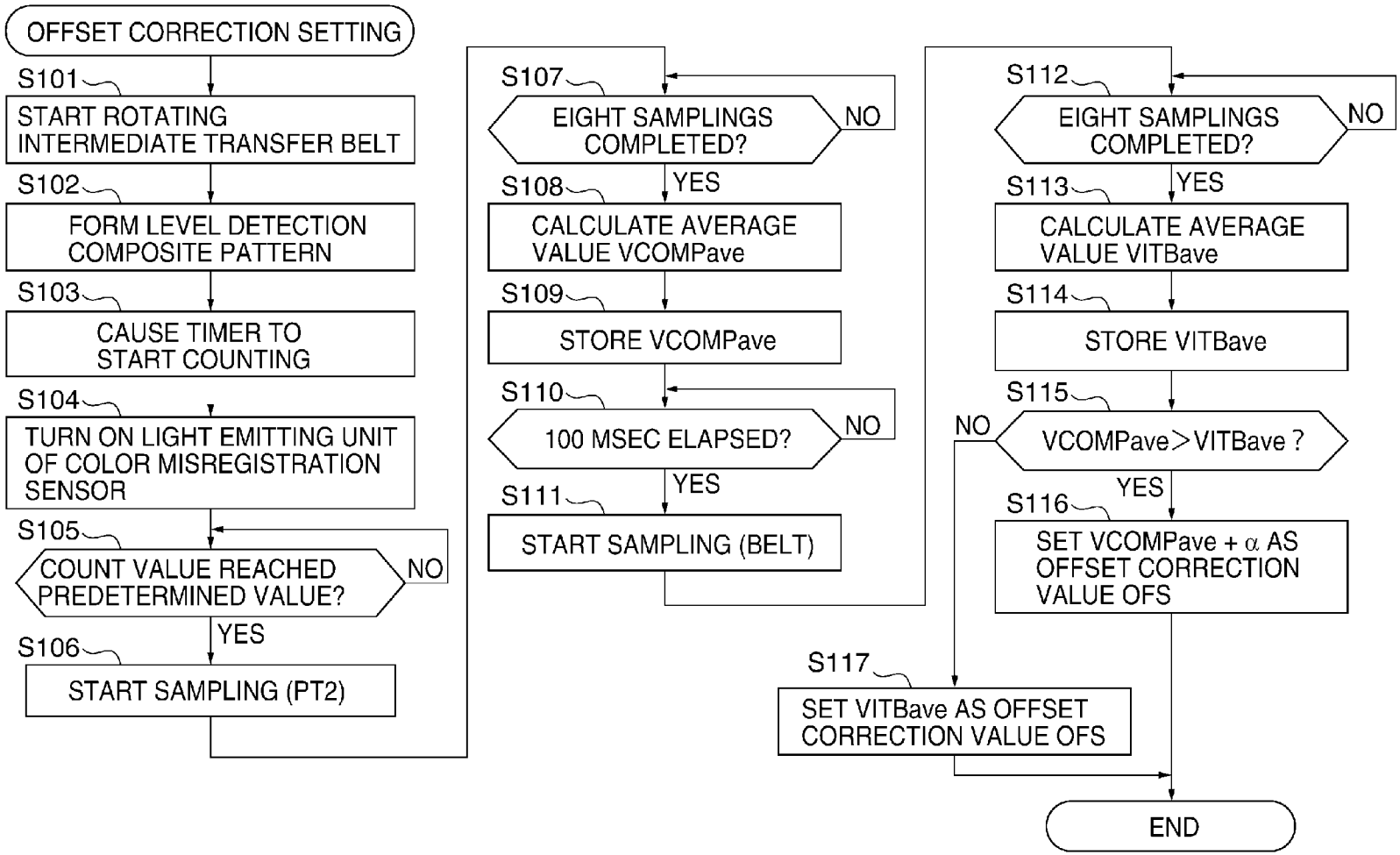
FIG. 13 is a flowchart of an offset correction setting process.

FIG. 13 is a flowchart of an offset correction setting process. This process is carried out, for example, when the power to the image forming apparatus 1 is turned on. Alternatively, this process may be carried out on a regular basis or may be carried out before the amount of color misregistration is calculated.

First, the CPU 70 causes the intermediate transfer belt 8 to start rotating (step S101) and controls the image forming units 50M and 50K to form the level detection composite pattern PT2 (step S102). Next, the CPU 70 causes a timer to start counting (step S103). Then, the CPU 70 causes the light emitting part 51 of the color misregistration sensor 40 to light up (step S104) and determines whether or not the count value of the timer has reached a predetermined value (a value corresponding to a time period required for the composite pattern PT2 to reach a detecting position) (step S105).

As a result of the determination, when the count value of the timer has reached the predetermined value, the CPU 70 starts sampling of the composite pattern PT2 (sampling of an output level read by the color misregistration sensor 40) (step S106). This sampling is performed at intervals of, for example, 4 msec. The CPU 70 determines whether or not eight samplings have been completed (step S107). This sampling period and the number of samplings are not limited to those examples.

When eight samplings have been completed, the CPU 70 calculates an average value VCOMPave (second output) of six sampling values obtained by excluding a maximum value and a minimum value of sampling values (step S108). The CPU 70 then stores the calculated average value VCOMPave in the RAM 71 (step S109).

Here, the maximum value and the minimum value should not necessarily be excluded in calculating the average value VCOMPave. The average value VCOMPave is a detection level of the composite pattern PT2. It should be noted that the K pattern on the upper side of the composite pattern PT2 is detected, and hence when the density of black (K) decreases due to environmental changes or the like, the average value VCOMPave increases accordingly.

The CPU 70 then waits until a predetermined time period (for example, 100 msec) has elapsed since the completion of sampling (step S110), and when the predetermined time period has elapsed, the CPU 70 starts sampling a surface of the intermediate transfer belt 8 (step S111). This sampling is performed at intervals of, for example, 4 msec. The CPU 70 then determines whether or not eight samplings have been completed (step S112). This sampling period and the number of samplings are not limited to those examples.

When eight samplings have been completed, the CPU 70 calculates an average value VITBave (first output) of six sampling values obtained by excluding a maximum value and a minimum value of sampling values (step S113). The CPU 70 then stores the calculated average value VITBave in the RAM 71 (step S114). Here, the maximum value and the minimum value should not necessarily be excluded in calculating the average value VITBave. The average value VITBave is a detection level of the intermediate transfer belt 8.

The CPU 70 then compares the value VCOMPave and the value VITBave, which are stored in the RAM 71, with each other and determines whether or not VCOMPave>VITBave holds (step S115).

As a result of the determination, when the value VCOMPave is equal to or smaller than the value VITBave (VCOMPave VITBave), it is determined that the density of black (K) has not decreased so much. Accordingly, the CPU 70 sets the value VITBave as an offset correction value OFS (step S117).

On the other hand, when the value VCOMPave is greater than the value VITBave (VCOMPave>VITBave), it is determined that the density of black (K) has decreased too much. Accordingly, the CPU 70 sets a value obtained by adding a predetermined value $\alpha$ to the value VCOMPave as the offset value OFS (step S116).

Figure 16:
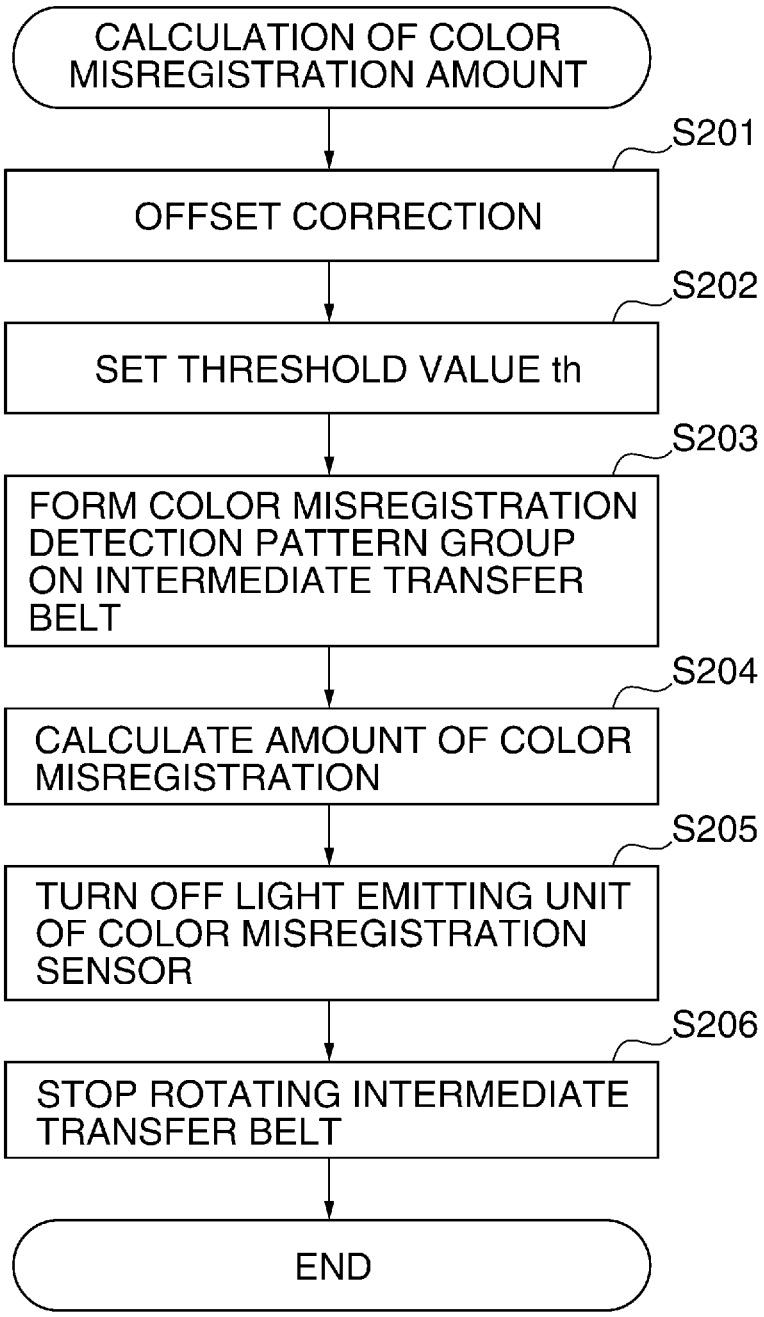
FIG. 16 is a flowchart of a color misregistration amount calculation process.

After the step S116 or the step S117, the process in FIG. 13 is brought to an end. The CPU 70 calculates the threshold value th whenever the offset correction setting process (FIG. 13) is completed. The timing of the calculation is not limitative, but the CPU 70 calculates the threshold value th after the offset correction setting process (FIG. 13) and before or during the color misregistration amount calculation process (FIG. 16). The calculated threshold value th is stored in the RAM 71 or nonvolatile memory.

A GND level is set as a result of offset correction. In offset correction, a value obtained by offsetting a GND level before offset by the offset correction value OFS is assumed as a GND level after offset. The threshold value th is determined using the GND level after offset as a reference.

A description will now be given of how the threshold value th is set. The threshold value th is set after offset correction, but for example, when the power is turned on, peak levels of respective patterns in the color misregistration detection pattern group 110 need to be sampled and stored in the RAM 71 in advance. The peak levels of the respective patterns are sampled by the peak hold circuit 76 (FIG. 10), and the CPU 70 calculates an average value of maximum values (the peak levels) of the sensor outputs corresponding to the color misregistration detection patterns of respective colors. An average value is then stored in the RAM 71.

The threshold value th is calculated by the threshold value adjustment unit 711 of the CPU 70 according to a mathematical expression below.

$$\text{Threshold value } th = \{(\text{average value of peak levels of color misregistration detection patterns}) - (\text{offset correction value } OFS)\} \times (R/100) \quad \text{[Mathematical Expression 1]}$$

Thus, an R % level of the detection level of the color misregistration detection pattern exceeding the GND level after offset is calculated as the threshold level th. The value of R % is not limitative. Here, the reason why the offset correction value OFS is subtracted from the average value of the four colors is that the threshold value th is actually set for a waveform obtained by offset correction (subtraction) using the subtracting circuit 77. As the offset correction value OFS, a value calculated in the offset correction setting process (FIG. 13) before color misregistration detection patterns are formed is used.

Referring now to FIGS. 14A and 14B and FIGS. 15A and 15B, a description will be given of the reason why the offset correction value OFS is set by comparing the value VCOMPave and the value VITBave with each other in the steps S115 to S117 in FIG. 13.

Figure 14A:
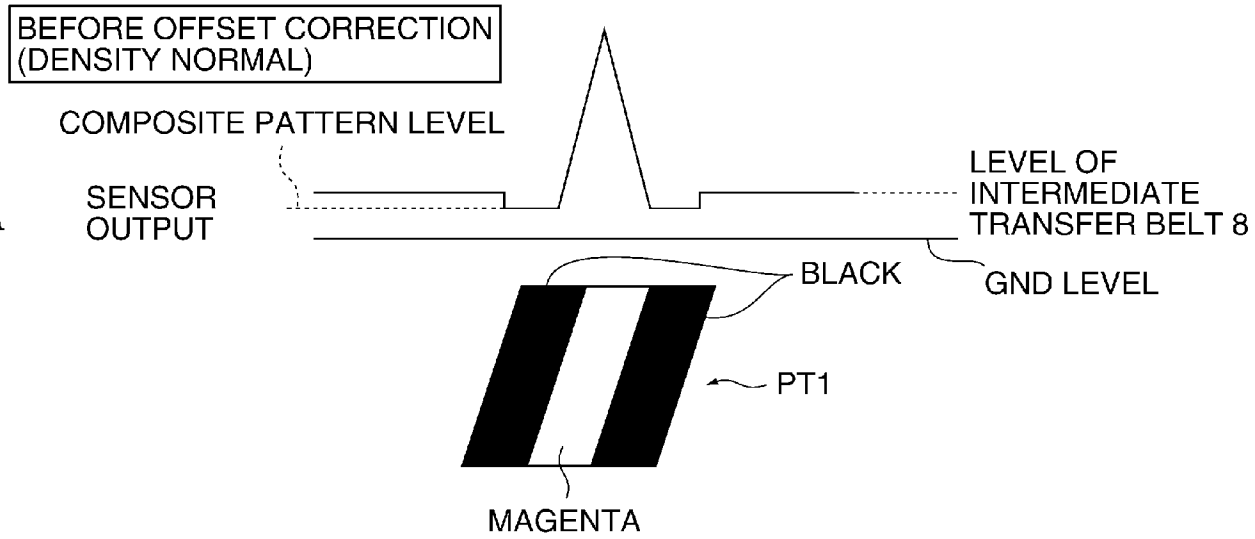
FIGS. 14A and 14B are views showing sensor output before binary coding of the composite pattern before and after offset correction in a state where the density of black has not decreased.
Figure 14B:
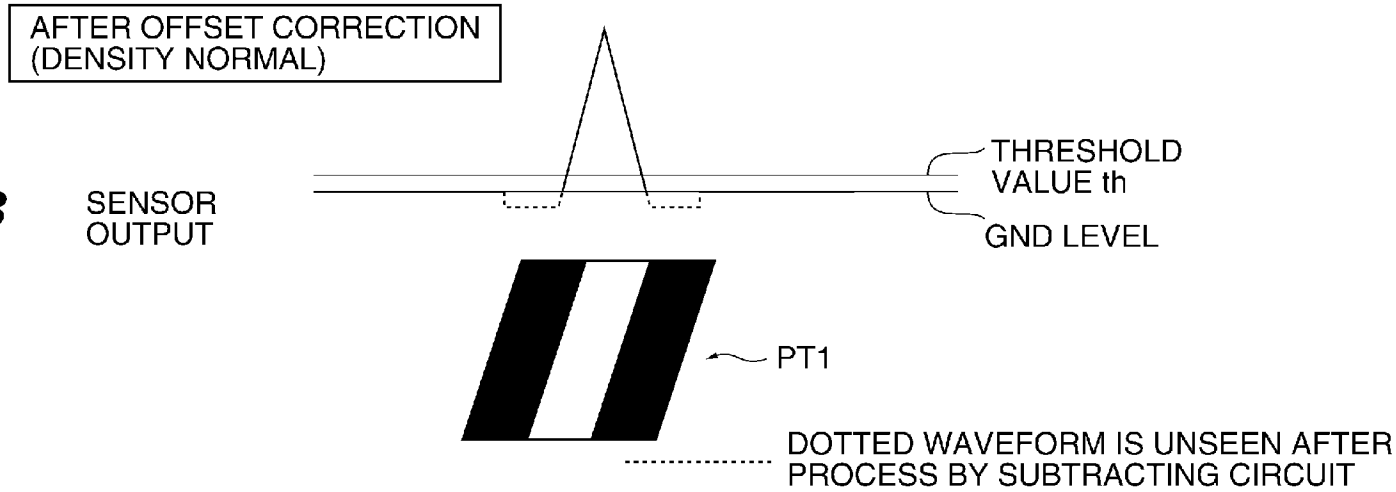
Figure 15A:
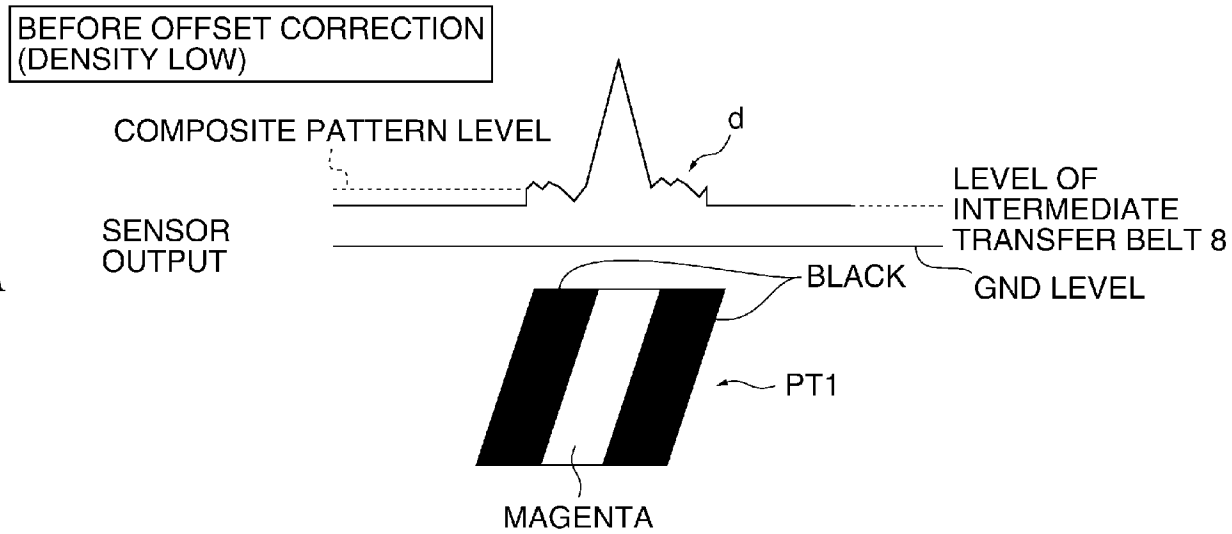
FIGS. 15A and 15B are views showing sensor output before binary coding of the composite pattern before and after offset correction in a state where the density of black has decreased.
Figure 15B:
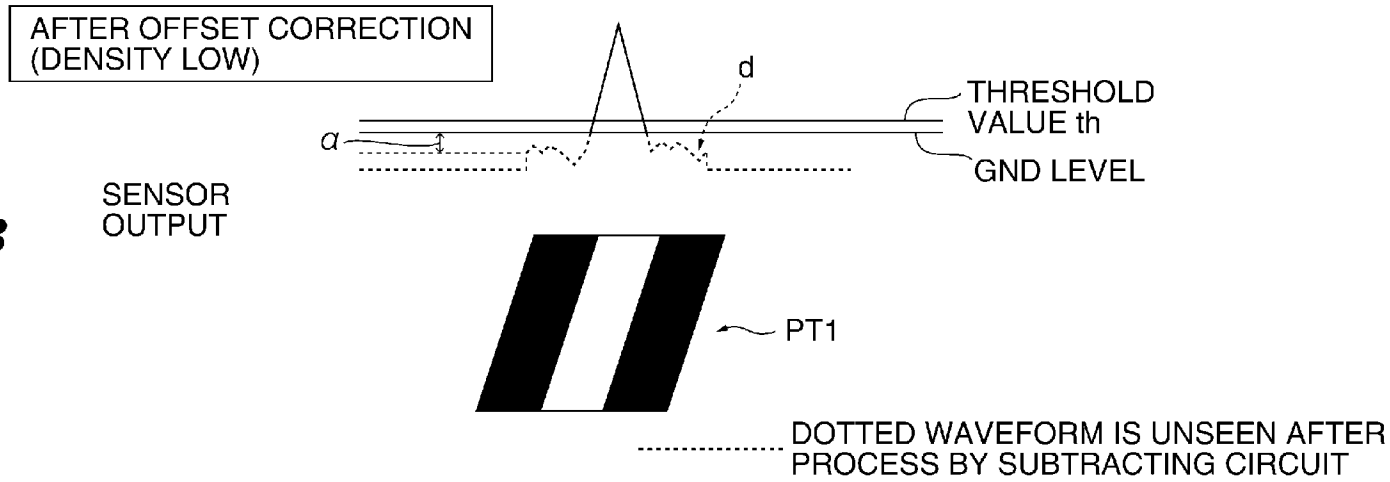

FIGS. 14A and 14B are views showing detection waveforms (sensor outputs before binary coding) obtained by the color misregistration sensor 40 reading the composite pattern PT1 before and after offset correction in a state where the density of black has not decreased. FIGS. 15A and 15B are views showing detection waveforms (sensor output before binary coding) obtained by the color misregistration sensor 40 reading the composite pattern PT1 before and after offset correction in a state where the density of black has decreased.

The composite pattern PT2 is a pattern formed by overlaying black on magenta. Thus, the detection level at the time when an area where black is overlaid on magenta in the composite pattern PT1 is estimated to be equal to the average value VCOMPave obtained by reading the composite pattern PT2.

When the density of black has not decreased, the detection level (the value VITBave) of the intermediate transfer belt 8 is higher than the detection level (estimated to be equal to the value VCOMPave) of a part where the K patterns are overlaid on the M pattern in the composite pattern PT1. The detection waveforms obtained when the K patterns are read are as shown in FIGS. 14A and 14B.

In this case, as shown in FIG. 14B, setting the offset correction value OFS at a value equal to the detection level of the intermediate transfer belt 8 makes the GND level coincide with the detection level of the intermediate transfer belt 8. The threshold level th is determined using the GND level as a reference and set at a value higher than the GND level.

On the other hand, when the density of black has decreased by a predetermined amount or greater, the detection level (the value VCOMPave) of a part where the K patterns are overlaid on the M pattern in the composite pattern PT1 is higher than the detection level (the value VITBave) of the intermediate transfer belt 8.

Moreover, a decrease in the density of black causes diffusely reflected light and sensor output to increase in a part where a large amount of magenta is exposed. For this reason, sensor output from the color misregistration sensors 40 in areas where magenta and black overlap in the composite pattern PT1 varies, and the output waveforms are as shown in FIGS. 15A and 15B.

In this case, assuming that the offset correction value OFS is set at a value equal to the detection level (the value VITBave) of the intermediate transfer belt 8, the sensor output value corresponding to an area of the magenta image covered with the black image in the composite pattern PT1 exceeds the threshold value th.

Also, assuming that the offset correction value OFS is set at a value equal to the value VCOMPave greater than the value VITBave, the GND level is equal to the value VCOMPave. However, depending on variations in sensor output from the color misregistration sensors 40, the sensor output value corresponding to the area of the magenta image covered with the black image in the composite pattern PT1 may exceed the threshold value th even when the threshold value th is set greater than the GND level.

This is because when the density of black has decreased, there is a wide variation in detection of the composite pattern PT, and hence if the value VCOMPave is used as it is as the offset correction value OFS, the value of an area where black and magenta overlap may exceed the threshold value th.

Accordingly, in the present embodiment, when the density of black has decreased (VCOMPave>VITBave), VCOMPave+$\alpha$ is set as the offset correction value OFS. As a result, the threshold value th is set greater than the sensor output value corresponding to the area of the magenta image covered with the black image in the composite pattern PT1.

It should be noted that although a value which is higher than a reference value (GND level) by a value (the predetermined value $\alpha$) corresponding to a peak value of detection levels of color misregistration detection patterns, the predetermined value $\alpha$ for calculating the threshold value th is not limited to the exemplified one. For example, the predetermined value $\alpha$ may be a fixed value or may be varied according to sampling variations.

A description will now be given of a color misregistration amount calculation sequence with reference to FIG. 16. FIG. 16 is a flowchart of a color misregistration amount calculation process. This process is started, for example, when the main power is turned on or after a predetermined number of or more images are formed.

First, the CPU 70 reads data on the offset correction value OFS stored in the offset correction setting process from the RAM 71 and causes the offset correction unit 718 to perform offset correction (step S201). Next, the CPU 70 sets the threshold value th calculated after the offset correction in the comparator 72 (step S202). Here, it is assumed that in a case where after the offset correction process is completed, and subsequently the amount of color misregistration is calculated, the intermediate transfer belt 8 is rotating, and the light emitting unit 51 of the color misregistration sensor 40 is emitting light.

Then, the CPU 70 controls the pattern forming unit 717 and the image forming unit 50 to form the color misregistration detection pattern group 110 (FIG. 11A) including the composite patterns PT1 on the intermediate transfer belt 8 (step S203).

After that, based on sensor output obtained by the color misregistration sensor 40 reading the color misregistration detection pattern group 110, the CPU 70 causes the pattern reading unit 712 and the color misregistration amount calculation unit 713 to calculate the amounts of color misregistration ($\Delta H$, $\Delta V$) as described above (step S204). Namely, misregistrations of the respective colors are detected from the digital signal 111 (FIG. 11B) obtained by binary-coding sensor outputs for the respective patterns in the color misregistration detection pattern group 110 using the threshold value th (calculation of the amounts of color misregistration). Thus, the CPU 70 detects positions of the composite patterns PT1 and others.

Then, the CPU 70 controls the light emission control unit 714 to turn off the light emitting unit 51 of the color misregistration sensor 40 (step S205), stops the intermediate transfer belt 8 (step S206), and brings the process in FIG. 16 to an end.

Based on the amounts of color misregistration calculated in this process, the CPU 70 performs color registration.

According to the present embodiment, the offset correction value OFS is set based on the first output (VITBave) from the color misregistration sensor 40 corresponding to reflected light from the intermediate transfer belt 8 and the second output (VCOMPave) from the color misregistration sensor 40 corresponding to reflected light from the composite pattern PT2.

Then, the threshold value th is set based on the offset correction value OFS. In calculation of the amount of color misregistration, the position of the composite pattern PT1 (substantially, a color misregistration of K with respect to M) is detected based on output from the color misregistration sensors 40 corresponding to reflected light from the composite pattern PT1 and the threshold value th. Similarly, positions of Y and C (color misregistrations with respect to M) are detected based on output from the color misregistration sensors 40 corresponding to reflected light from patterns in the color misregistration detection pattern group 110 and the threshold value th.

As a result, even when the density of an image in a low-reflectivity color (black (K)) has decreased, a misregistration of this color (K) is detected with high accuracy. Also, color registration is performed based on a calculated amount of color misregistration, and hence even when the density of an image in a low-reflectivity color has decreased due to environmental changes, or the like, color registration is performed with high accuracy.

Particularly when VCOMPave>VITBave holds, a value obtained by adding the predetermined value $\alpha$ to the value VCOMPave is set as the offset correction value OFS. This prevents sensor output in an area where black and magenta overlap from exceeding the threshold value th due to variations in sensor output from the color misregistration sensor 40 and makes it possible to calculate the amount of color misregistration with high accuracy.

Moreover, since it is unnecessary to correct the densities of the respective colors before performing color registration, downtime increase is avoided. Further, since it is unnecessary to form high-density patches for density correction whenever color registration is to be performed, poor cleaning of toner on the intermediate transfer belt 8 is unlikely to occur.

It should be noted that in the offset correction setting process (FIG. 13), the offset correction value OFS should not necessarily be stored in the RAM 71, but may be stored in nonvolatile memory. When the offset correction value OFS is stored in nonvolatile memory, the CPU 70 may read out the offset correction value OFS when carrying out the color misregistration amount calculation process (FIG. 16) after the main power is turned off once and then turned on again.

It should be noted that although it is assumed that the reference color is magenta (M), another chromatic color with higher reflectivity than that of the intermediate transfer belt 8 may be the reference color. Also, toner colors constituting the composite patterns PT1 and PT2 are not limited to the illustrated ones. In the composite patterns PT1 and Pt2, reflectivity of a color of a pattern on an upper side has only to be higher than that of a color of a pattern on a lower side on which the pattern on the upper side is overlaid.

It should be noted that although in the above description of the present embodiment, color registration for four colors including the reference color is performed, the number of colors is not limited to four as long as a plurality of colors is subjected to color registration.

Moreover, for example, a method for adjusting a density of images of respective colors before performing a color misregistration correction is conceivable. However, according to the present invention, since images for density adjustment for respective colors are not formed, it is possible to decrease downtime compared to the method in which images for density adjustment are formed before performing a color misregistration correction.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-084484, filed Apr. 16, 2014, which is hereby incorporated by reference herein in its entirety.

What is claimed is:

1. An image forming apparatus comprising:

a first image forming unit configured to form a first image using a toner of a first color;

a second image forming unit configured to form a second image using a toner of a second color having lower reflectivity than that of the first color;

an image carrier to which the first image and the second image are transferred;

a controller configured to control said first image forming unit and said second image forming unit to form a first measurement image and a second measurement image on said image carrier, respectively, wherein the first measurement image including a first pattern formed by said first image forming unit and a second pattern formed by said second image forming unit, wherein the second pattern being superposed on the first pattern in the first measurement image, wherein the second measurement image including a third pattern formed by said first image forming unit and a fourth pattern formed by said second image forming unit, and wherein the fourth pattern being superposed on the third pattern in the second measurement image;

an irradiation unit configured to irradiate the first measurement image and the second measurement image with light;

a light-receiving unit configured to, in a case where said light-receiving unit received reflected light from the first measurement image, output a first signal corresponding to reflected light from the first measurement image, in a case where said light-receiving unit received reflected light from the second measurement image, output a second signal corresponding to the reflected light from the second measurement image, and, in a case where said light-receiving unit received reflected light from said image carrier, output a third signal corresponding to the reflected light from said image carrier;

a setting unit configured to set a threshold value based on the second signal and the third signal output from said light-receiving unit;

a determination unit configured to compare the first signal and the threshold value and determine information on a positional relationship between the first image and the second image based on a comparison result; and a correction unit configured correct for a color misregistration between the first image and the second image based on the information.

2. The image forming apparatus according to claim 1, wherein when a value of the second signal is smaller than a value of the third signal, said setting unit sets the threshold value based on the value of the third signal, and wherein when the value of the second signal is greater than the value of the third signal, said setting unit sets the threshold value based on the value of the second signal.

3. The image forming apparatus according to claim 1, wherein when a value of the second signal is smaller than a value of the third signal, said setting unit sets the threshold value based on a value of the first signal and the value of the third signal, and wherein when the value of the second signal is greater than the value of the third signal, said setting unit sets the threshold value based on the value of the first signal and the value of the second signal.

4. The image forming apparatus according to claim 1, wherein said image carrier conveys the first measurement image and the second measurement image, wherein the second pattern includes a gap, and wherein the first pattern appears in the gap in the second pattern.

5. The image forming apparatus according to claim 1, wherein said controller controls said first image forming unit to form another measurement image on said image carrier, wherein when receiving reflected light from the another measurement image, said light-receiving unit outputs another signal corresponding to the reflected light from the another measurement image, and wherein said determination unit compares the first signal output from the light-receiving unit, the another signal output from the light-receiving unit and the threshold value and determines the information based on a comparison result.

6. The image forming apparatus according to claim 1, wherein the comparison result comprises a first timing at which a value of the first signal has changed from a value smaller than the threshold value to a value greater than the threshold value and a second timing at which the value of the first signal has changed from a value greater than the threshold value to a value smaller than the threshold value, and wherein said determination unit determines the information based on the first timing and the second timing.

7. The image forming apparatus according to claim 1, wherein said light-receiving unit receives diffusely reflected light from the first measurement image and diffusely reflected light from the second measurement image.

8. The image forming apparatus according to claim 1, wherein the first color is a chromatic color, and the second color is an achromatic color.

* * * * *